US006913481B2

(12) United States Patent
Marshall et al.

(10) Patent No.: US 6,913,481 B2
(45) Date of Patent: Jul. 5, 2005

(54) MODULAR JACK WITH VISUAL INDICATOR

(75) Inventors: Robert E. Marshall, Elizabethtown, PA (US); M. Richard Page, Middletown, PA (US)

(73) Assignee: FCI Americas Technology, Inc., Reno, NV (US)

( * ) Notice: Subject to any disclaimer, the term of this patent is extended or adjusted under 35 U.S.C. 154(b) by 45 days.

(21) Appl. No.: 10/685,669

(22) Filed: Oct. 15, 2003

(65) Prior Publication Data

US 2004/0147161 A1 Jul. 29, 2004

Related U.S. Application Data

(60) Provisional application No. 60/442,140, filed on Jan. 23, 2003.

(51) Int. Cl.[7] ..... H01R 3/00
(52) U.S. Cl. ..... 439/490; 439/676
(58) Field of Search ..... 439/490–491, 439/676

(56) References Cited

U.S. PATENT DOCUMENTS

| | | | | |
|---|---|---|---|---|
| 4,978,317 A | | 12/1990 | Pocrass | 439/490 |
| 5,428,806 A | | 6/1995 | Pocrass | 395/800 |
| 5,685,737 A | * | 11/1997 | Morin et al. | 439/490 |
| 5,897,386 A | * | 4/1999 | Baxter et al. | 439/79 |
| 6,290,538 B1 | | 9/2001 | Pocrass | 439/578 |
| 6,325,664 B1 | * | 12/2001 | Someda et al. | 439/490 |
| 6,457,993 B1 | * | 10/2002 | Espenshade | 439/490 |
| 6,464,533 B1 | * | 10/2002 | Ma et al. | 439/490 |
| 6,544,076 B2 | | 4/2003 | Pocrass | 439/676 |
| 6,558,203 B2 | | 5/2003 | Pocrass | 439/676 |
| 6,568,965 B2 | | 5/2003 | Pocrass | 439/676 |
| 6,592,397 B2 | | 7/2003 | Pocrass | 439/418 |
| 6,595,805 B2 | | 7/2003 | Pocrass | 439/676 |

* cited by examiner

*Primary Examiner*—Truc Nguyen
(74) *Attorney, Agent, or Firm*—Woodcock Washburn LLP

(57) ABSTRACT

A preferred embodiment of a modular jack includes a visual indicator for indicating a condition of an electrical signal, and a body capable of receiving at least a portion of a connector plug. The body has a first outer surface located in a first plane, and a second outer surface located in a second plane substantially perpendicular to the first plane. The body defines a pocket for receiving at least a portion of the visual indicator. The pocket extends into the body from the first and the second outer surfaces so that the at least a portion of the visual indicator can be inserted into the pocket in a first direction substantially perpendicular to the first plane, and in a second direction substantially perpendicular to the second plane.

28 Claims, 3 Drawing Sheets

MODULAR JACK WITH VISUAL INDICATOR

CROSS REFERENCE TO RELATED APPLICATIONS

This application claims priority under 35 U.S.C. § 119(e) to U.S. Provisional Patent Application Ser. No. 60/442,140, which was filed Jan. 23, 2003 and is hereby incorporated by reference in its entirety.

FIELD OF THE INVENTION

The present invention is related to modular jacks comprising a visual indicator, such as a lighted electronic diode ("LED"), for indicating the condition of an electrical signal being transmitted through the modular jack. U.S. Pat. Nos. 5,685,737; 6,464,533; and 6,457,993, each of which is incorporated by reference herein in its entirety, have disclosures related to the present invention.

BACKGROUND OF THE INVENTION

Modular receptacle jacks, also commonly referred to as RJ connectors, are commonly used in telecommunications and data networking systems to transmit electrical signals between two or more electronic components. RJ connectors are typically used in conjunction with a visual indicator, e.g., an LED. The visual indicator can be used to indicate the status of the connector, e.g., whether a signal is being transmitted through the connector. The visual indicator can also be used to indicate the presence of a fault within the connector.

RJ connectors having one or more visual indicators mounted directly thereon have been developed. See, e.g., U.S. Pat. No. 4,978,317. Such connectors typically have one or more five-sided pockets formed in the body thereof for receiving the visual indicators. In other words, the visual indicator is usually accommodated in a pocket defined by a top wall, an opposing bottom wall, two opposing side walls, and a rear wall of the connector body. Hence, the top, bottom, side, and rear surfaces of the visual indicator are typically enclosed by the connector body when the visual indicator is installed in such a pocket.

Installing a visual indicator in a five-sided pocket requires inserting the visual indicator into the pocket from one direction only (usually from the front of the connector). The need to insert the visual indicator while the RJ connector and the visual indicator are in one particular relative orientation can decrease the flexibility with which the assembly process for the connector can be conducted, particularly where the visual indicator is installed using automated equipment.

The wiring needed to energize the visual indicator is usually routed through the body of the connector and the rear wall of the pocket. Alternatively, the wiring needed to energize the visual indicator can be routed through the wall or structure of the body located below the visual indicator.

Forming the two or more openings or internal passages needed to accommodate the wiring can present difficulties, particularly in molded connector bodies. For example, the flash that commonly results from the molding process can block or otherwise obstruct the relatively small-diameter openings or passages. Also, the structure of the connector body between the openings or passages can be relatively thin and weak due to the relatively small spacing therebetween. Moreover, the portion of the mold in which the structure between the openings or passages is formed can be difficult to fill due to the relatively small spacing therebetween.

SUMMARY OF THE INVENTION

A preferred embodiment of a modular jack comprises a jack body having top, bottom, front, and rear walls, a plug receiving opening in the front wall, and an LED assembly receiving pocket in the front wall. The pocket comprises an opening in the front wall, and an opening in the bottom wall. The openings in the front and bottom walls substantially correspond to the width and length of the LED assembly to be inserted in the pocket such that the LED assembly can be inserted from both the front wall and the bottom wall.

Another preferred embodiment of a modular jack comprises a visual indicator for indicating a condition of an electrical signal, and a body capable of receiving at least a portion of a connector plug. The body has a first outer surface located in a first plane, and a second outer surface located in a second plane substantially perpendicular to the first plane.

The body defines a pocket for receiving at least a portion of the visual indicator. The pocket extends into the body from the first and the second outer surfaces so that the at least a portion of the visual indicator can be inserted into the pocket in a first direction substantially perpendicular to the first plane, and in a second direction substantially perpendicular to the second plane.

Another preferred embodiment of a modular jack comprises an LED assembly comprising an LED and a terminal electrically coupled to the LED, and a body having a front and a bottom outer wall. The body has a first pocket formed therein for receiving a connector plug and defined at least in part by the front wall. The body also has a second pocket formed therein for receiving the LED. The second pocket is defined at least in part by the front and the bottom outer walls so that the LED can be inserted into the second pocket from the front and the bottom of the body.

Another preferred embodiment of a modular jack comprises a visual indicator for indicating a condition of an electrical signal, and a body for mating with a connector plug. The body has a pocket formed therein for receiving at least a portion of the visual indicator. The pocket is accessible to the at least a portion of the visual indicator from a first and a substantially perpendicular second direction.

The modular jack also comprises at least one: of a crush rib formed on the body so that the crush rib securely engages the at least a portion of the visual indicator when the at least a portion of the visual indicator is inserted into the pocket; adhesive for bonding the at least a portion of the visual indicator to the body; a lip formed on the body and extending along a perimeter of the pocket so that the lip retains the at least a portion of the visual indicator in the pocket; and a shield positioned over the body and covering at least a portion of the pocket so that the shield retains the at least a portion of the visual indicator in the pocket.

BRIEF DESCRIPTION OF THE DRAWINGS

The foregoing summary, as well as the following detailed description of preferred embodiments, is better understood when read in conjunction with the appended drawings. For the purpose of illustrating the invention, the drawings show embodiments that are presently preferred. The invention is not limited, however, to the specific instrumentalities disclosed in the drawings. In the drawings.

DESCRIPTION OF PREFERRED EMBODIMENTS

A preferred embodiment of a modular jack 10 is depicted in FIGS. 1 to 4. The figures are each referenced to a common coordinate system 11 depicted therein. The embodiment of the modular jack 10 described herein is commonly referred to as an RJ45 connector. This particular type of modular jack is described for exemplary purposes only, as the inventive concepts described herein can be applied to other types of modular jacks including, for example, RJ11 connectors. Moreover, the inventive concepts can be used in modular jacks having active or passive filtering elements or circuitry.

Figure 3:
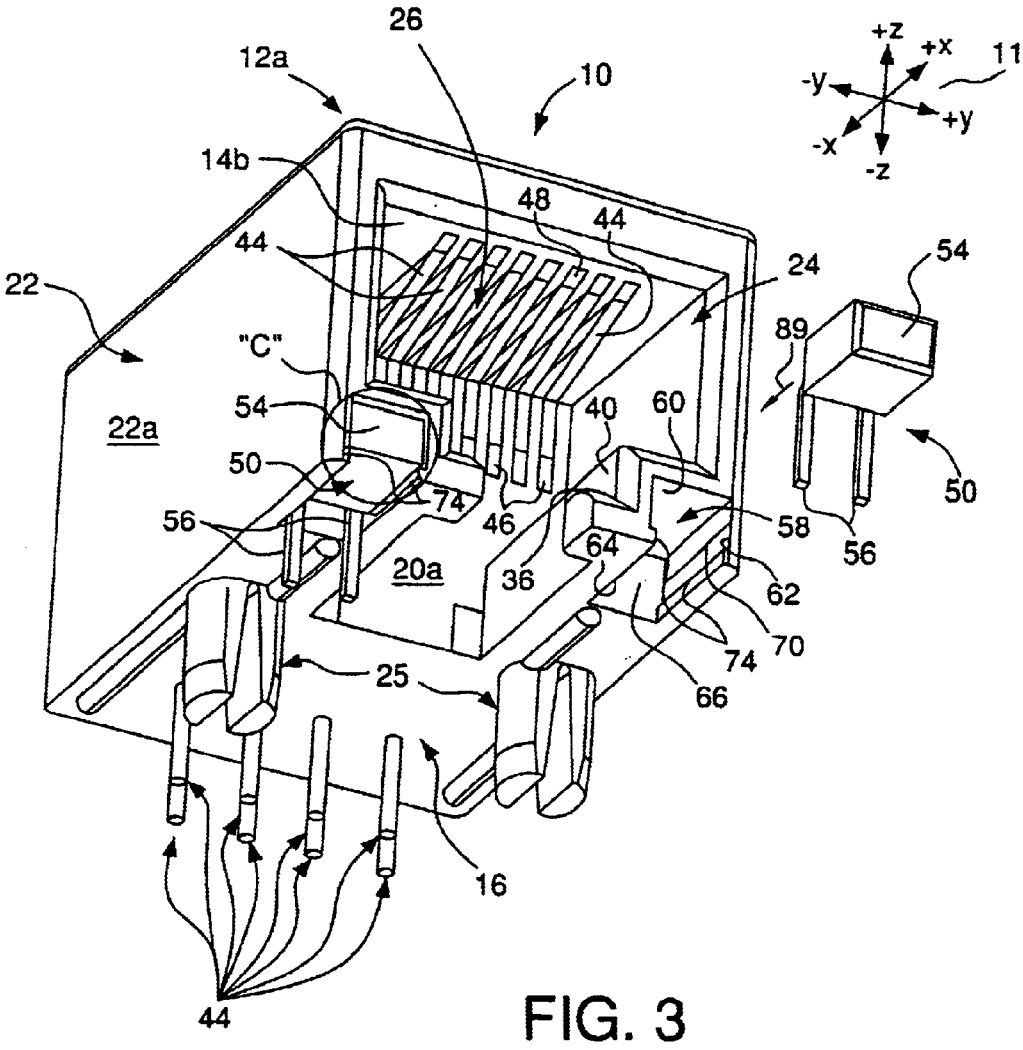
FIG. 3 is a perspective view the modular jack shown in FIG. 1, with an alternative embodiment of the body thereof, depicting the second LED assembly installed in the alternative embodiment of the body, and the first LED being installed in the alternative embodiment of the body from the bottom of the modular jack.
Figure 4:
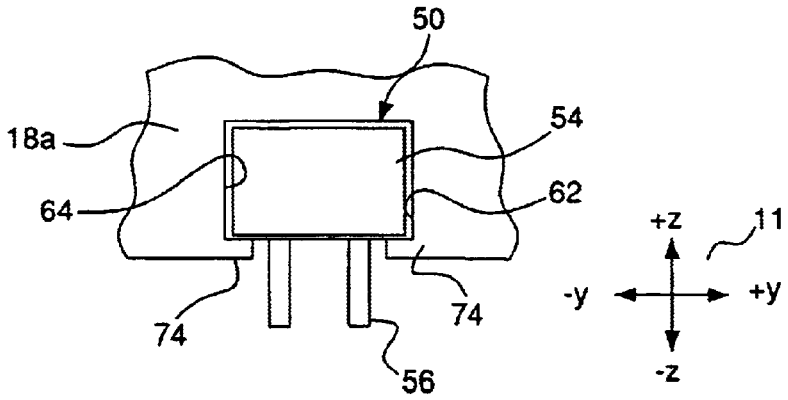
FIG. 4 is a magnified front view of the area designated "C" in FIG. 3.

The modular jack 10 includes a one-piece dielectric housing or body 12. (FIGS. 3 and 4 depict an alternative embodiment 12*a* of the body 12. The body 12*a* is substantially identical to the body 12, with the exception noted below. The following description of the body 12 thus applies equally to the body 12*a*, unless otherwise noted.)

The body 12 can be formed, for example, from molded plastic. The body 12 includes a top wall 14 having an outer surface 14*a* and an inner surface 14*b*, and a bottom wall 16 having an outer surface 16*a*.

The body 12 also includes a front wall 18 having an outer surface 18*a*, and a rear wall 20 having an inner surface 20*a*. The body 12 further includes a first side wall 22 having an outer surface 22*a*, and a second side wall 24 having an outer surface 24*a*.

The outer surfaces 14*a*, 16*a* and the inner surface 14*b* are substantially perpendicular to the outer surfaces 18*a*, 22*a*, 24*a* and the inner surface 20*a*. The outer surface 18*a* and the inner surface 20*a* are substantially perpendicular to the outer surfaces 22*a*, 24*a*.

Figure 1:
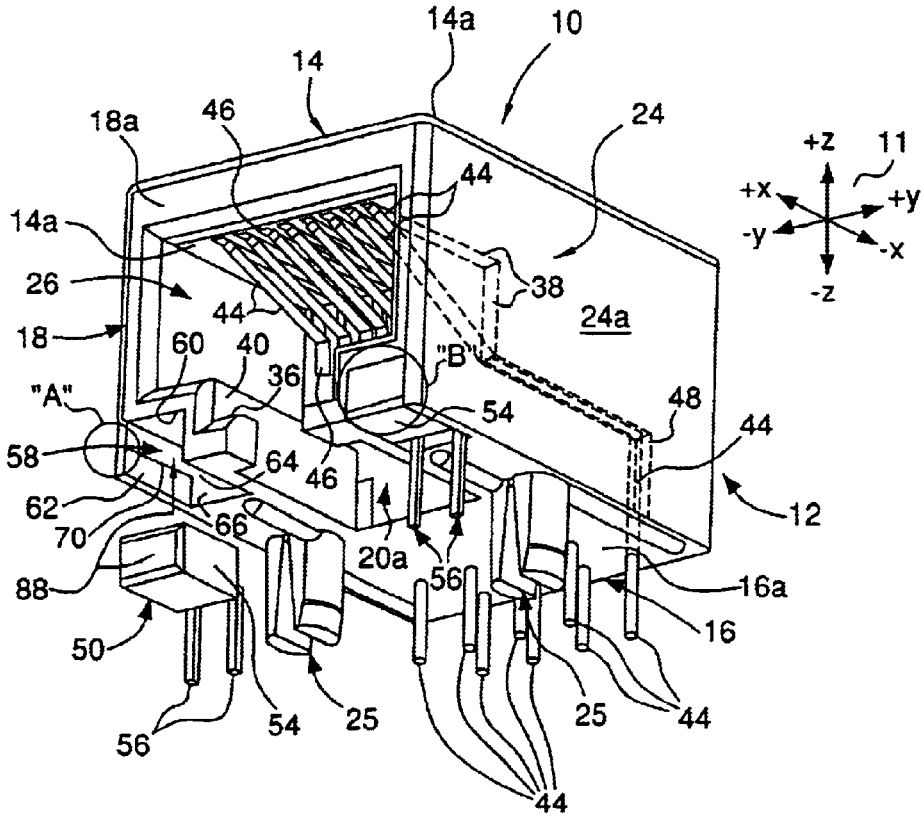
FIG. 1 is a perspective view of preferred embodiment of a modular jack, depicting a first LED assembly installed in a body of the modular jack, and a second LED being installed in the body from the front of the modular jack.

It should be noted that directional terms such as "top, "bottom," etc. are used herein in reference to the component orientations depicted in FIGS. 1 and 3. These terms are used for illustrative purposes only, and are not intended to limit the scope of the appended claims.

The body 12 can include mounting pegs 25 formed on the bottom wall 16 for mounting the modular jack 10 on a substrate such as a printed circuit (PC) board.

A cavity 26 is formed in the body 12, and extends inward from the front wall 18 thereof. The cavity 26 can receive a conventional RJ45 mating plug (not shown).

The mating plug can include a dielectric housing having a free end for insertion into the cavity 26, and a cord input end having a cavity for receiving a multi-conductor cord. The mating plug can also include a resilient locking tab integrally connected to the free end of the dielectric housing by a flexible hinge, and extending rearward therefrom in an oblique direction.

The mating plug can also include a terminal receiving side having partitions that define side-by-side slots in communication with the cavity. Substantially flat, electrically conductive contact terminals are positioned within the slots and extend into the cavity. The contact terminals can include insulation-piercing tangs for establishing electrical engagement with associated conductors of the cord, and upper edge portions for establishing electrical contact external to the plug.

The bottom wall 16 of the modular jack 10 can include inclined ramps 36 for guiding the mating plug into the cavity 26 (see FIGS. 1 and 3). The bottom wall 16 can also include shoulders 40 for maintaining the mating plug in place within the cavity 26. A substantially rectangular recess or keyway (not shown) can optionally be formed along inner surfaces of the first and second side walls 22, 24 for receiving an optional mating key formed on the side of the mating plug.

The modular jack 10 further comprises a plurality of electrically-conductive leads 44 (see FIGS. 1 and 3). The leads 44 can be formed from round, rectangular, or stamped wire, and can be coated with a precious metal such as gold to enhance the conductivity, longevity, and reliability thereof. A first portion of each lead 44 is located within the cavity 26 for establishing electrical contact with the mating plug. A second portion of each lead 44 projects downwardly from the bottom wall 16 for establishing electrical contact with a substrate such as a PC board.

A plurality of slots 46 and internal passages 48 are formed in the body 12 for accommodating the leads 44 (only one of the internal passages 48 is depicted in FIG. 1, for clarity). Each slot 46 extends inward into the top and rear walls 14, 20 from the respective inner surfaces 14*b*, 20*a* thereof. Each internal passage 48 adjoins a corresponding one of the slots 46 (see FIG. 1).

A first end of each lead wire 44 is positioned in a respective one of the slots 46, in the portion of the slot 46 formed in the top wall 14. The lead wire 44 extends into the portion of the slot 46 formed in the rear wall 20, and into the adjoining internal passage 48. The slots 46 permit the lead wires 44 to flex in response to contact with the mating plug when the modular jack 10 is mated with therewith.

A portion of each lead wire 44 extends through a respective one of the internal passages 48 so that an end portion of the lead wire 44 projects downward from the bottom wall 16 (see FIG. 1). The internal passages 48 can be spaced apart and staggered so that respective end portions of each lead wire 44 can be inserted in corresponding holes in a substrate. For example, the internal passages can be laterally spaced by approximately 0.050 inch so that the spacing between the respective end portions of the lead wires 44 corresponds to the standard center-to center hole spacing in a PC board.

The modular jack 10 also includes a first and a second visual indicator. The visual indicators can be used to indicate the status of the modular jack, e.g., whether a signal is being transmitted through the modular jack 10. The visual indicators can also be used, for example, to indicate the presence of a fault within the modular jack 10. It should be noted that indications relating to these particular operating parameters are specified for exemplary purposes only. The visual indicators can be used to provide indications relating to other operating parameters in alternative embodiments.

The first and second visual indicators can each be an LED assembly 50. The LED assemblies 50 each comprise an LED 54, and terminals 56. Each set of terminals 56 is electrically coupled to, and extends downwardly from the corresponding LED 54. The terminals 56 can be inserted in corresponding holes formed in the substrate on which the modular jack 10 is mounted.

It should be noted that the use of an LED assembly as the visual indicator in the modular jack 10 has been specified for exemplary purposes only. Other types of visual indicators can be used in alternative embodiments.

The LEDs 54 of the LED assemblies 50 are each positioned in a respective pocket 58 formed in the body 12. Each pocket 58 is defined by an upper inner surface 60 of the body 12, an outboard inner surface 62 of the body 12, and an inboard inner surface 64 of the body 12 that opposes the outboard inner surface 62. Each pocket 58 is also preferably defined by a rear inner surface 66 of the body 12 that adjoins the upper, outboard, and inboard inner surfaces 60, 62, 64. The upper, outboard, inboard, and rear inner surfaces 60, 62, 64, 66 are preferably sized so that the width (y-axis dimension), height (z-axis dimension), and length (x-axis dimension) of each pocket 58 are approximately equal to the respective width, height, and length of the LEDs 54, although in certain instances the length of each pocket 58 can be greater than the length of the LEDs 54.

Each pocket 58 is open to, and accessible from, both the front and the bottom of the body 12 (from the perspective of FIGS. 1 and 3). This feature can facilitate insertion of each LED 54 into its respective pocket 58 from the front or, alternatively, from the bottom of the body 12. (The directions of insertion when the LED assemblies 50 are installed from the bottom and the front of the body 12 are denoted respectively by the arrow 88 in FIG. 1, and the arrow 89 in FIG. 3.) Hence, the manufacturer of the modular jack 10 is not limited to installing the LED assemblies 50 while the LED assemblies 50 and the body 12 are in one particular relative orientation. The manufacturing flexibility provided by this feature can be particularly beneficial where the LED assemblies 50 are installed using automated equipment.

The terminals 56 of each LED assembly 50 project downward from the LED 54, as shown in FIGS. 1, 2B, 3, and 4. This feature, in combination with the open bottom of the pockets 58, obviates the need for passages or any other specialized structure within the body 12 to accommodate lead wires for the LED assemblies 50. The difficulties associated with forming such passages or structure, described in detail above, can thus be avoided through the use of the inventive concepts described herein.

The LEDs 54 can be retained within their corresponding pockets 58 using one or more of the following concepts. Each of the following concepts can provide support and retention of the LEDs 54 in the vertical direction, and can thereby facilitate the use of a pockets, such as the pockets 58, that are open (and thereby accessible) from the bottom thereof.

The LEDs 54 can be retained in their corresponding pockets 58 by a suitable adhesive. The adhesive can be used to bond each LED 54 to one or more of the upper, outboard, inboard, and rear inner surfaces 60, 62, 64, 66 of the body 12. Preferably, the amount of adhesive used for this purpose is relatively small so as to avoid potential manufacturing problems associated with excessive adhesive.

Figure 2A:
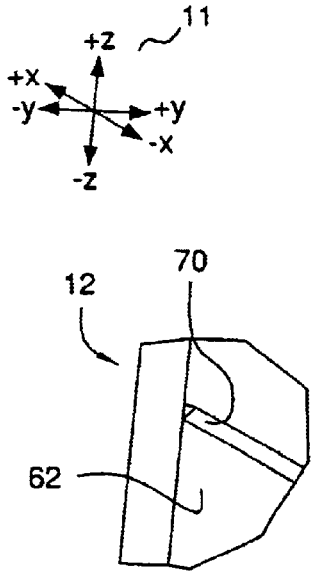
FIG. 2A is a magnified perspective view of the area designated "A" in FIG. 1.
Figure 2B:
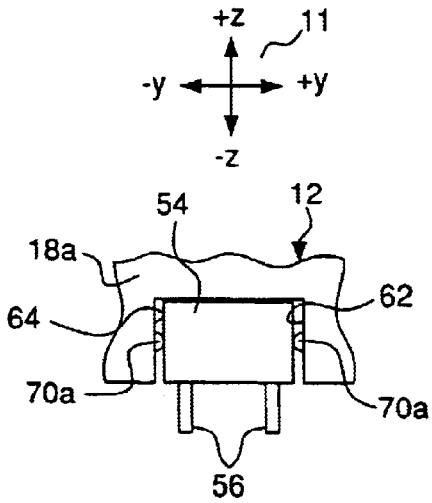
FIG. 2B is a magnified front view of the area designated "B" in FIG. 1.

The LEDs 54 can also be retained in their corresponding pockets 58 by one or more crush ribs 70 positioned within each pocket 58 (see FIGS. 1 and 2A). The crush ribs 70 can be formed on one or both of the outboard and inboard inner surfaces 62, 64 of the body 12.

Each crush rib 70 is sized so that the crush rib 70 interferes with the corresponding LED 54 as the LED 54 is inserted into the pocket 58. Forcing the LED 54 into the pocket 58, against the resistance generated by this interference, causes the crush rib 70 become crushed and deformed. The resulting remnants 70*a* of the crush rib 70 act as a wedge that urges the LED 54 toward the opposing outboard or inboard inner surface 62, 64 of the of body 12 (see FIG. 2B). The resulting friction between the remnants 70*a* and the sides of the LED 54 can retain the LED 54 in the pocket 58.

The LEDs 54 can also be retained in the pockets 58 by optional lips 74 formed on the body 12. The lips 74 are depicted on an alternative embodiment of the body 12 shown in FIG. 3 (the body 12*a* is otherwise substantially identical to the body 12). The lips 74 can be formed along lower edges of the outboard and inboard inner surfaces 62, 64. The spacing between the two lips 74 associated with each pocket 58 is smaller than the width (y-axis dimension) of the LED 54. The lips 74 can thereby interfere with downward movement (movement in the "−z" direction) of the LED 54, and can thus prevent the LED 54 from exiting the pocket 58 in the downward direction.

The portions of the first and a second side walls 22, 24 adjacent the pockets 58 can be formed sufficiently thin so as to flex outwardly in response to contact between the LED 54 and the corresponding lips 74 as the LED 54 is inserted into its corresponding pocket 58 from a vertical direction. When the LED 54 are positioned against the upper inner surface 60 of the body 12, the lips 74 can snap back under the LED 54 to retain the LED 54 in place.

Figure 5:
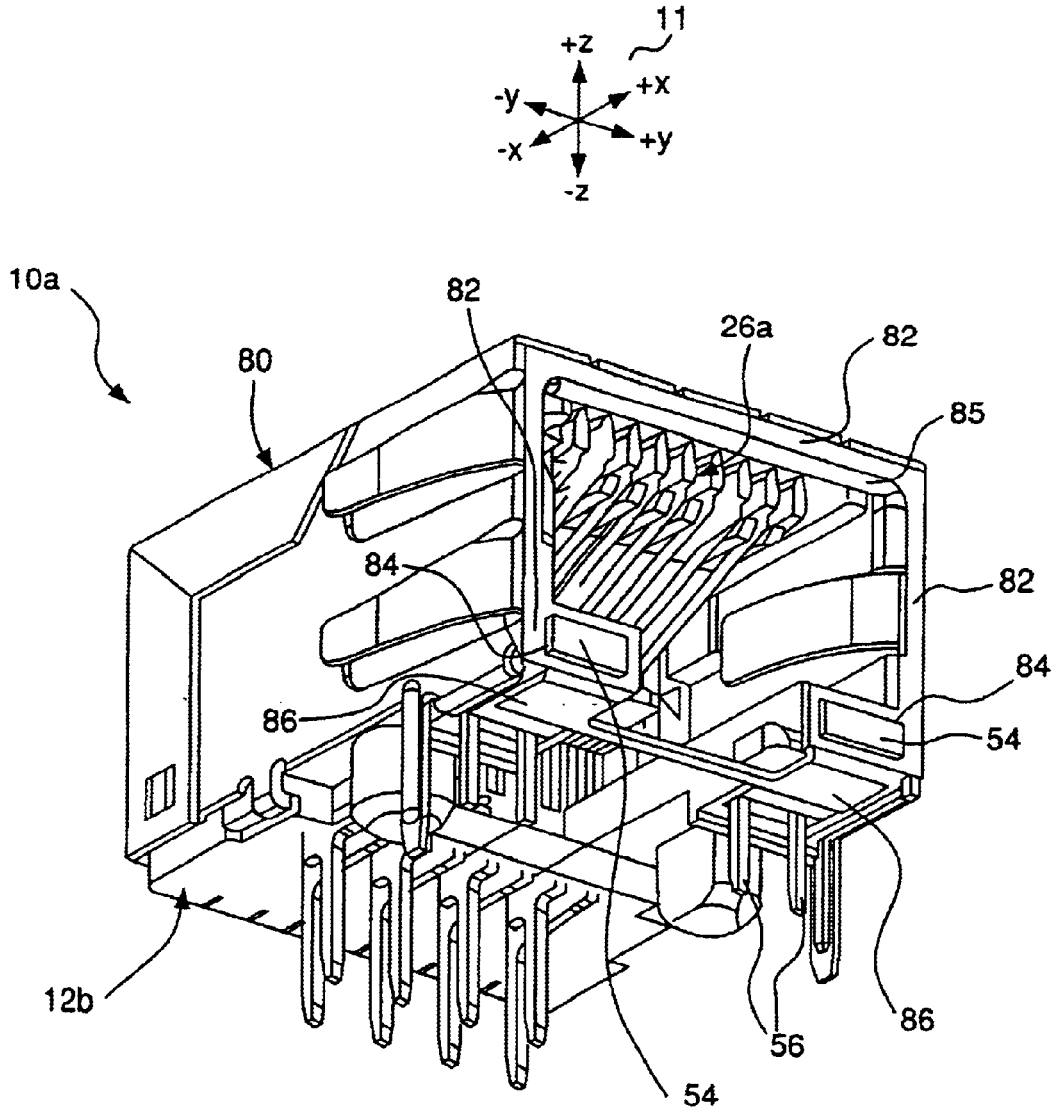
FIG. 5 is a perspective view of another alternative embodiment of the modular jack shown in FIGS. 1–4, the alternative embodiment having a metallic shield installed over a body thereof.

The LEDs 54 can also be retained in the pockets 54 using a metallic shield 80. The shield 80 is depicted in FIG. 5 in connection with a modular jack 10*a*. The modular jack 10*a* represents an alternative embodiment of the modular jack 10. The shield 80 can provide EMI shielding of the modular jack 10*a*, and can perform other functions of a conventional shield in a manner commonly known among those skilled in the art of connector design. (The shield 80 can also be used as part of the modular jack 10.)

The shield 80 includes a front wall 82. The front wall 82 has a first and a second aperture 84 formed therein for providing visual access to the LEDs 54. The front wall 82 also has a third aperture 85 formed therein for providing access to a cavity 26*a* of the body 12*b*.

The shield 80 comprises a tab portion 86 for retaining the LEDs 54. The tab portion 86 can be formed, for example, by bending a lower portion of the front wall 82 in the rearward ("−x") direction after the shield 80 has been positioned over the body 12*b*. The tab portion 86 can interfere with movement of the LEDs 54 in the downward ("−z") direction, and can thereby prevent the LEDs 54 from exiting the pockets 58 in the downward direction. The front wall 82 can interfere with movement of the LEDs 54 in the forward ("−x") direction, and can thereby prevent the LEDs 54 from exiting the pockets 58 in the forward direction.

It should be noted that each of the above-described concepts for retaining the LEDs 54 the pockets 58 can be used alone, or in combination with one or more of the other concepts.

It is to be understood that even though numerous characteristics of the present invention have been set forth in the foregoing description, together with details of the structure and function of the invention, the disclosure is illustrative only, and changes may be made in detail, especially in matters of shape, size, and arrangement of the parts, within the principles of the invention.

What is claimed is:

1. A modular jack, comprising:

a jack body having top, bottom, front, and rear walls;

a plug receiving opening in the front wall;

an LED assembly receiving pocket in the front wall, the pocket comprising an opening in the front wall and an opening in the bottom wall, wherein the openings in the front and bottom walls substantially correspond to the width and length of an LED assembly to be inserted in the pocket such that the LED assembly can be inserted from both the front wall and the bottom wall; and at least one of: (i) a lip formed on the bottom wall along an edge of the pocket for retaining the LED assembly within the pocket, the lip deflecting in response to insertion of the LED assembly from the bottom wall; (ii) a crush rib formed on a first inner wall of the pocket for urging the LED assembly toward an opposing second inner wall of the pocket to form an interference fit between the pocket and the LED assembly so that the LED assembly is suspended in the pocket by way of the interference fit; and (iii) a metallic shield surrounding the jack body, the shield comprising a front face and a tab portion, wherein the front face has apertures formed therein for exposing LEDs of the LED assembly, and the tab portion covers the opening in the bottom wall and thereby retains the LED assembly in the pocket.

2. The modular jack of claim 1, wherein the LED assembly is retained within the pocket by an adhesive.

3. A modular jack, comprising:

a visual indicator for indicating a condition of an electrical signal;

a body capable of receiving at least a portion of a connector plug, the body having a first outer surface located in a first plane, and a second outer surface located in a second plane substantially perpendicular to the first plane, the body defining a pocket for receiving at least a portion of the visual indicator, the pocket extending into the body from the first and the second outer surfaces so that the at least a portion of the visual indicator can be inserted into the pocket in a first direction substantially perpendicular to the first plane, and in a second direction substantially perpendicular to the second plane; and at least one of: (i) a lip defined by the body along an edge of the pocket for retaining the at least a portion of the visual indicator within the pocket, the lip deflecting in response to insertion of the at least a portion of the visual indicator in the pocket; (ii) a crush rib formed on a first inner wall of the pocket for urging the at least a portion of the visual indicator toward an opposing second inner wall of the pocket to form an interference fit between the pocket and the at least a portion of the visual indicator so that the at least a portion of the visual indicator is suspended in the pocket by way of the interference fit; and (iii) a metallic shield positioned over the body, the shield comprising a tab portion that retains the at least a portion of the visual indicator in the pocket.

4. The modular jack of claim 3, wherein the first inner wall of the pocket is an outboard inner surface of the body, the second inner wall of the pocket is an inboard inner surface of the body, the pocket is defined at least in part by the outboard inner surface and the inboard inner surface of the body, a top inner surface of the body, and a rear inner surface of the body.

5. The modular jack of claim 3, wherein the visual indicator comprises an LED, the body defines two of the lips, the lips define an entrance to the pocket, and the first and the second lips are spaced apart by a distance less than a width of the LED.

6. The modular jack of claim 3, wherein the shield comprises a front wall that covers at least a portion of an first entrance to the pocket, and a tab portion that covers at least a portion of a second entrance to the pocket.

7. The modular jack of claim 3, further comprising a second of the visual indicators, wherein the body has a second of the pockets formed therein for receiving at least a portion of the second of the visual indicators.

8. The modular jack of claim 3, wherein the body has a cavity formed therein for receiving the at least a portion of a connector plug, and the modular jack further comprises a lead wire having a first portion positioned in the cavity for establishing electrical contact with the mating plug, and a second portion extending from the body for establishing electrical contact with a substrate.

9. The modular jack of claim 3, wherein the first outer surface is an outer surface of a front wall of the body, and the second outer surface is an outer surface of a bottom wall of the body.

10. The modular jack of claim 4, wherein the outboard and inboard inner surfaces are substantially perpendicular, and the upper and rear inner surfaces are substantially perpendicular to the outboard and inboard inner surfaces.

11. The modular jack of claim 4, wherein the at least a portion of the visual indicator is retained in the pocket by an adhesive bond between a surface of the visual indicator and at least one of the outboard, inboard, rear, and upper inner surfaces.

12. The modular jack of claim 4, wherein the visual indicator comprises an LED, and the outboard and inboard inner surfaces are spaced apart by a distance approximately equal to a width of the LED.

13. The modular jack of claim 12, wherein the visual indicator further comprises a terminal electrically coupled to and extending downward from the LED.

14. The modular jack of claim 12, wherein the outboard inboard, and upper inner surfaces each have a length approximately equal to a length of the LED, the outboard, inboard, and rear inner surfaces each have a height approximately equal to a height of the LED, and the rear inner surface has a width approximately equal to a width of the LED.

15. The modular jack of claim 5, wherein the first and second lips are formed respectively on the first and second inner surfaces.

16. The modular jack of claim 5, wherein at least one of the first and the second lips resiliently deflects away from the other of the first and second lips in response to insertion of the LED into the pocket.

17. The modular jack of claim 6, wherein the first entrance is substantially perpendicular to the second entrance.

18. The modular jack of claim 6, wherein the tab portion is formed by bending a portion of the front wall after the shield is positioned over the body.

19. The modular jack of claim 6, wherein the front wall interferes with movement of the at least a portion of the visual indicator in the first direction, and the tab portion interferes with movement of the at least a portion of the visual indicator in the second direction.

20. The modular jack of claim 6, wherein the front wall has an aperture formed therein for providing visual access to the visual indicator.

21. The modular jack of claim 8, wherein the body has a slot formed therein for receiving an end of the lead wire, and an internal passage adjoining the slot for routing the lead within the body.

22. A modular jack, comprising:

an LED assembly comprising an LED and a terminal electrically coupled to the LED; and a body having a front and a bottom outer wall, the body having a first pocket formed therein for receiving a connector plug and defined at least in part by the front wall, the body also having a second pocket formed therein for receiving the LED, the second pocket being formed at least in part by the front and the bottom outer walls so that the LED can be inserted into the second pocket from the front and the bottom of the body; and at least one of: (i) a lip formed on the body along an edge of the second pocket for retaining the LED in the second pocket, the lip deflecting in response to insertion of the LED in the second pocket; (ii) a crush rib formed on a first inner wall of the second pocket for urging the LED toward an opposing second inner wall of the second pocket to form an interference fit between the second pocket and the LED so that the LED is suspended in the second pocket by way of the interference fit; and (iii) a metallic shield surrounding the jack body, the shield comprising a front face and a tab portion, wherein the front face has apertures formed therein, and a tab portion that covers the opening in the bottom wall and thereby retains the LED assembly in the second pocket.

23. The modular jack of claim 22, wherein the first inner wall of the pocket is an outboard inner surface of the body, the second inner wall of the pocket is an inboard inner surface of the body, the second pocket is defined at least in part by the outboard inner surface and the inboard inner surface of the body, a top inner surface of the body, and a rear inner surface of the body.

24. The modular jack of claim 23, wherein the LED is retained in the second pocket by an adhesive bond between a surface of the LED and at least one of the outboard, inboard, upper, and rear inner surfaces.

25. The modular jack of claim 23, wherein at least one of the outboard and the inboard inner surfaces has a crush rib formed thereon for securely engaging a surface of the LED when the LED is inserted into the second pocket.

26. The modular jack of claim 22, wherein the body defines two of the lips, the lips define an entrance to the second pocket, and the lips are spaced apart by a distance less than a width of the LED.

27. The modular jack of claim 22, further comprising a shield positioned over the body and having a portion that covers at least a portion of the second pocket so that the shield retains the LED in the second pocket.

28. A modular jack, comprising:

a visual indicator for indicating a condition of an electrical signal; and a body for mating with a connector plug, the body having a pocket formed therein for receiving at least a portion of the visual indicator, the pocket being accessible to the at least a portion of the visual indicator from a first and a substantially perpendicular second direction; and at least one of:

a crush rib formed on a first inner surface of the body that defines the pocket so that the crush rib urges the at least a portion of the visual indicator toward an opposing second inner surface of the body and the body securely engages the at least a portion of the visual indicator when the at least a portion of the visual indicator is inserted into the pocket and the visual indicator is suspended in the pocket by way of the interference fit;

a lip formed on the body and extending along an edge of the pocket so that the lip deflects in response to insertion of the visual indicator in the pocket and retains the at least a portion of the visual indicator in the pocket; and a shield positioned over the body and comprising a tab portion that retains the at least a portion of the visual indicator in the pocket.

* * * * *